US007093376B2

(12) United States Patent
Regen

(10) Patent No.: US 7,093,376 B2
(45) Date of Patent: Aug. 22, 2006

(54) HAIR DRYING AND SHAPING SYSTEM

(75) Inventor: Paul Regen, Felton, CA (US)

(73) Assignee: Ennova Direct, Inc., Santa Cruz, CA (US)

( * ) Notice: Subject to any disclaimer, the term of this patent is extended or adjusted under 35 U.S.C. 154(b) by 102 days.

(21) Appl. No.: 10/969,154

(22) Filed: Oct. 19, 2004

(65) Prior Publication Data

US 2006/0080857 A1 Apr. 20, 2006

(51) Int. Cl.
*A45D 20/12* (2006.01)

(52) U.S. Cl. ..... 34/96; 132/500; 392/384

(58) Field of Classification Search ..... 34/96, 34/97, 98, 99, 100; 132/56, 200; 392/380, 392/384; 601/17
See application file for complete search history.

(56) References Cited

U.S. PATENT DOCUMENTS 2,037,695 A * 4/1936 Brownlee et al. ..... 34/553
2,832,157 A * 4/1958 Hudson ..... 34/90
4,409,998 A * 10/1983 Bauer ..... 132/227
5,267,372 A * 12/1993 Jones ..... 15/344
5,444,215 A * 8/1995 Bauer ..... 219/222
5,924,215 A * 7/1999 Goodsell ..... 34/98
6,925,728 B1 * 8/2005 Busa et al. ..... 34/96
2004/0250829 A1 * 12/2004 Fukuyama ..... 132/56

* cited by examiner

*Primary Examiner*—S. Gravini
(74) *Attorney, Agent, or Firm*—Donald R. Boys; Central Coast Patent Agency, Inc.

(57) ABSTRACT

A hair drying and shaping system is provided and has a vacuum channel connected to a vacuum source for containing hair disposed therein for treatment; a hot air channel connected to a hot air source and having communication with the vacuum channel for measurable delivery of heated air into the vacuum channel; and a control interface for determining, setting, and activating features and parameters thereof during operation.

16 Claims, 10 Drawing Sheets

Section AA

HAIR DRYING AND SHAPING SYSTEM

FIELD OF THE INVENTION

The present invention is in the field of cosmetology, more particularly related to hair drying and shaping equipment and pertains to a system for drying and shaping long hair.

BACKGROUND OF THE INVENTION

In the field of cosmetology, hair processing is one of the more prevalent tasks performed. There are many types of processes performed on hair including hair cutting, hair shaping, hair styling, hair coloring, and so on. In hair shaping or styling, typically heating is used for such as hair straightening, hair curling, or simply hair drying.

Hair straightening and curling may involve a hand-held device that provides a heat source and has suitable apparatus for accepting locks of a client's hair for processing. A curling iron is one such device. Likewise, simple devices meant to be inserted into one's hair are available to hold the hair in a conforming position while a hair dying device is used to heat and dry the hair allowing it to conform to whatever shape it was positioned by the inserted device. Curlers and hair clips are included in these types of simple devices.

A complete styling process may include the use of one or more chemicals and several different types of devices before satisfactory results may be obtained. In a home setting, such devices and home-styling products are also available.

A problem with many hair styling applications is that there are timing requirements, complex instructions, and numerous devices that must be used. Poor results may be realized particularly when the right devices and heat settings are not used properly for the prescribed time periods for those portions of the styling process. For example, not enough heat may result in poor hair shaping conformity while too much heat can damage hair. Likewise, using differing devices may prove somewhat clumsy in that devices have to be set aside and then picked up again repeatedly.

What is clearly needed is a hair drying and shaping device having a manageable heat source that may be used as both a hair-shaping tool and a hair-drying tool. Such a device would result in fewer processing steps for many hair-processing applications performed in the home or in a place of cosmetology.

SUMMARY OF THE INVENTION

A hair drying and shaping system is provided and includes a vacuum channel connected to a vacuum source for containing hair disposed therein for treatment, a hot air channel connected to a hot air source and having communication with the vacuum channel for measurable delivery of heated air into the vacuum channel and a control interface for determining, setting, and activating features and parameters thereof during operation.

In a preferred embodiment, the vacuum and hot air channels are aligned and facilitate respective airflows in a substantially opposing direction. In one embodiment the vacuum channel and hot air channel are formed as a double-walled tubular construction defining the vacuum channel surrounded by the hot air channel. In this embodiment, the vacuum source is a motor and fan creating airflow of ambient air directed away from a subject.

In one embodiment, the vacuum source and the hot air source are contained in a handle portion of the system and wherein the system is a hand-held device. In another embodiment, the vacuum source is contained in a floor canister connected to a hand-held portion of the system by a vacuum hose. In still another embodiment, the vacuum source is contained in a wall-mounted canister connected to a hand-held portion of the system by a vacuum hose.

In one embodiment, the vacuum channel and hot air channel are contained in an annular tubular structure. In another embodiment, the vacuum channel and hot air channel are contained in a rectangular tubular structure. In still another embodiment the hot air channel is defined as a delivery system of separate hose sections interfacing with the vacuum channel via openings placed there through and openings placed through the hose sections.

In one embodiment, the hot air channel is defined as a delivery system comprising one or more V-shaped channels encased by a flexible jacket, the hot air delivered into the V-shaped channels.

According to a further embodiment, the system includes at least one temperature-sensing device communicating with the vacuum channel for reporting current temperature of the air therein during operation, and at least one temperature-sensing device communicating with the hot air channel for reporting current temperature of the air therein during operation. In still a further embodiment the system includes a processor running an algorithm for estimation and reporting of process time left, reportable at any point in time using results from temperature sensing and considering input variables related to process description, hair type, and hair condition. In a variant of his embodiment, the system includes a peripheral display connected by data link or wireless communication link to the system, the display enabling a client view of estimated time left at any point in time of a process being performed.

According to another embodiment of the present invention, in a system for drying and shaping hair, a method for heat delivery to hair being processed is provided and includes steps of (a) powering on a motor to create a vacuum airflow through a first channel, the channel receiving hair therein by force of vacuum and staging the hair for processing and, (b) powering on a motor and heat element to create a hot air flow through a second channel or set of channels, the hot air flow having communication with the vacuum airflow through one or more wall structures of the first channel.

In one aspect of the method in step (a) the channel is a rectangular tube structure having at least one hair separation feature. In another aspect the channel is an annular tube structure.

In one aspect of the method in step (a) the system is hand held and the vacuum motor is contained in the handle section of he system. In another aspect the vacuum motor is contained in a floor canister connected to the hand-held portion of the system by a vacuum hose. In still another aspect the vacuum motor is contained in a wall-mounted canister connected to the hand-held portion of the system by a vacuum hose.

In a preferred aspect of the method in step (b) communication is achieved through a plurality of small openings place through the one or more wall structures of the first channel. In a variant of this aspect where there is a set of channels, in step (b) the openings placed through the one or more wall structures of the first channel match up with like openings placed through one or more wall structures of the set of channels, communication there through established by snapping the set of channels into predetermined positions aligning the openings.

In another embodiment related to the hair drying and shaping system, the system further includes at least one permeable and externally-accessible compartment affixed to a position inline with hot air flow, the compartment containing a scented material for dispensing into the vacuum chamber. In a variation of this embodiment, the contained material is a hair conditioning material.

BRIEF DESCRIPTION OF THE DRAWING FIGURES

DESCRIPTION OF THE PREFERRED EMBODIMENTS

According to embodiments of the present invention, the inventor provides a novel system for drying and shaping hair. The system and methods in various embodiments will be described in enabling detail below.

Figure 1:
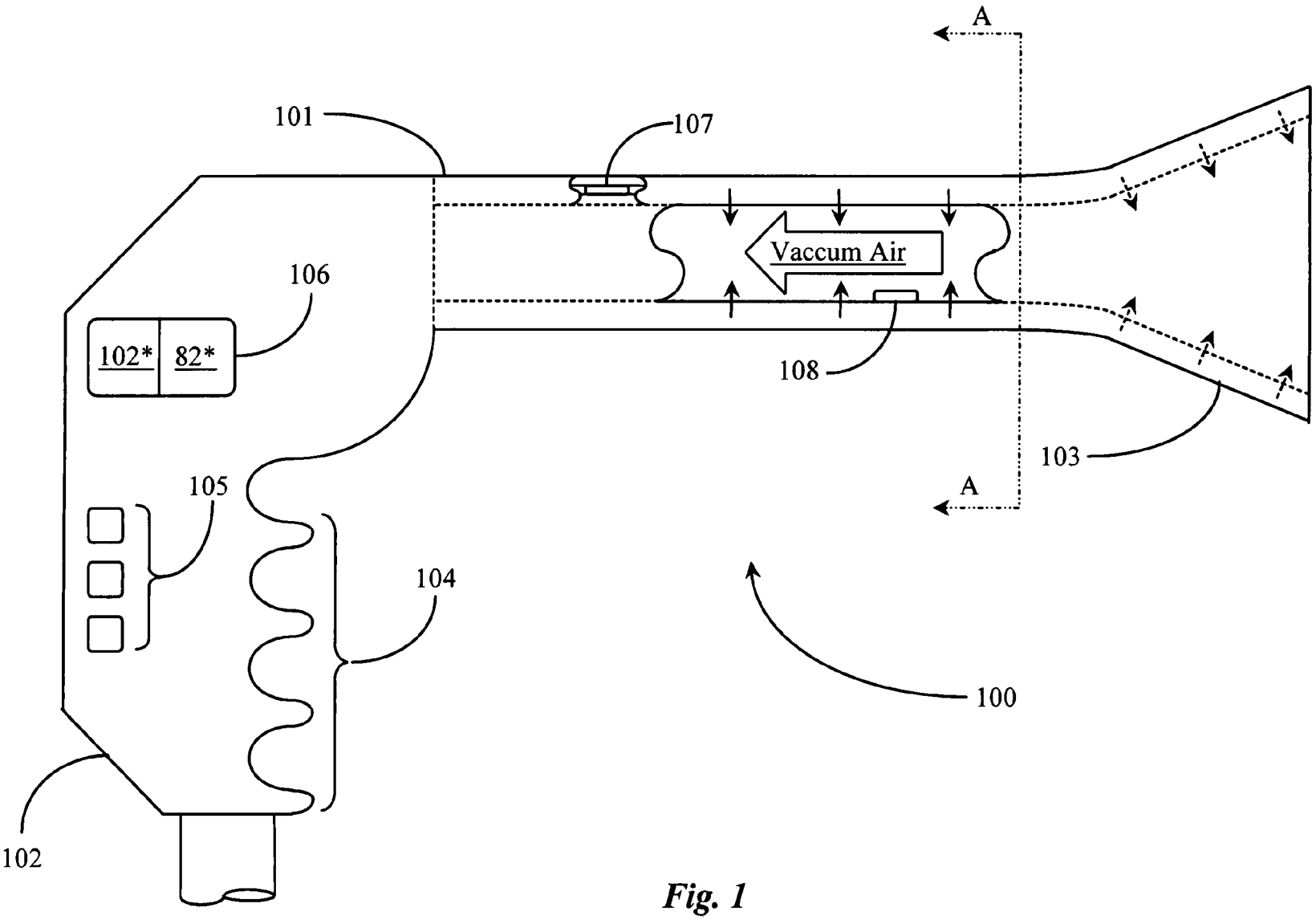
FIG. 1 is a plan view of a hair-styling device according to an embodiment of the present invention.

FIG. 1 is a plan view of a hair-styling device 100 according to an embodiment of the present invention. System 100 is adapted for use in the industry of cosmetology including, in various embodiments, home and industrial applications. System 100 is a hand-held device in this embodiment and has an elongated aperture 101 adapted for delivery of warm or hot air and for vacuum intake of ambient air including the hair of a client being serviced.

System 100 has a handle portion 102, which may be permanently or semi-permanently affixed to aperture 101. That is to say that in one embodiment, aperture 101 may be an attachment that is removable and replaceable with another attachment of differing design and application. Aperture 101 and handle portion 102 may be fabricated of a durable, heat-resistant polymer material and the two pieces may be contiguously formed or provided as separate components that may be affixed together to form system 100.

Aperture 101 is, in this example, a double walled tubular structure assuming a semi-annular or annular shape. That is not to say that other shapes may not be used in the formation of aperture 101. Rectangular-shaped tubing or elliptically shaped tubing may also be used to construct aperture 101 without departing from the spirit and scope of the present invention. Aperture 101 has a conical or funneled portion 103 formed contiguously therewith or otherwise affixed thereto.

Funneled portion 103 is adapted to cover a substantial area of a subject's head such that warm air may come into contact with the immediate area of a subject's scalp and so that maximum hair containment may be affected with the hair being disposed or displaced into the center tubular structure via force of vacuum air as illustrated by a block arrow labeled same. The overall length of aperture 101, including the funneled portion thereof shall be sufficient to contain a subject's particularly long hair up to, perhaps 36 inches in length. This however should not be construed as a limitation as much longer hair could be accommodated. Aperture 101 may, in one embodiment, be provided in a form of a plurality of separate sections that may be snapped together or otherwise affixed together in order to attain or match a particular length of hair being dried and/or shaped.

Handle portion 102 is, in this example, hollowed sufficiently to contain components including electronics required for operation of system 100. A handle grip section 104 is provided for facilitating a user's right or left hand such that the system may be held and manipulated comfortably. Handle section 102 has an array of operation buttons 105, which are connected to circuitry and switch mechanisms contained in the interior portion of the handle section.

Operation buttons 105 comprise a user interface for powering system 100 on or off, for initiating warm air delivery and intensity, and for initiating vacuum action and intensity. For example, each operation button 105 may be adapted to provide several settings each of which may be attained through sequential depression or click of each button. For example, one of buttons 105 depressed or clicked once may initiate delivery of warm air through an outer channel formed by the double walled tubular structure of aperture 101. A second click of the same may cause a raise in temperature setting and intensity of warm air delivery. It will be clear to one with skill in the art of hair drying and shaping equipment that there are many user interfacing options and arrays that may be provided to such a device in order to activate and operate various features of the device.

Aperture 101 has an inner tube adapted for intake of air as previously described, and an outer jacket or channel for delivering warm or hot air. Aperture 101 is equipped with at least 2 temperature-sensing devices illustrated herein as a temperature-sensing device 108 and a temperature-sensing device 107. Device 108 is located substantially inside the inner vacuum tube structure of aperture 101 and device 107 is located substantially within the channel adapted to deliver warm or hot air. In illustration, a portion of the wall or walls of aperture 101 is removed to enable visualization of sensor locations.

Temperature sensing device 108 is adapted to sense and report the current air temperature of the vacuum air entering the inner tubular structure of aperture 101. Temperature sensing device 107 is adapted to sense and report the current air temperature of warm or hot air being delivered through the outer tubular structure of aperture 101. A wall that separates the outer tubular structure from the inner tubular structure of aperture 101 has a plurality of small openings provided there through and strategically located there along.

The openings are logically illustrated herein by a plurality of arrows illustrating air delivery from the outer tubular structure into the inner vacuum tubular structure.

In practice of the present invention, powering on a vacuum apparatus causes ambient air to rush into the inner tubular structure along with a subject's hair, which is displaced therein during operation. Warm or hot air, the temperature and delivery of which may be controlled is measurably introduced into the inner vacuum tubular structure according to the general direction of the arrows through the previously described small openings. In this way, long hair may be measurably dried and shaped while it is displaced inside the inner vacuum tubular structure of aperture 101.

A temperature display window 106 is provided in a strategic location on handle portion 102 and is adapted to electronically receive and display temperature results reported by temperature sensing devices 108 and 107 during operation. In this example, the ambient air temperature of the inner tubular structure of aperture 101 may be assumed to read 82 degrees Fahrenheit while the current temperature of air being delivered for heat drying may be assumed to read 102 degrees Fahrenheit. Due to injection of the hotter air, the inner temperature of 82* Fahrenheit may be considered a raised temperature from an ambient air temperature reading that might result if no hot air were being delivered. This illustrates that the inner temperature immediately surrounding a subject's hair may be measurably controlled. For example, a user may raise or lower the temperature of the outer warm air delivery structure and intensity of delivery, thereby causing the inner temperature intimate to the hair being dried to be raised or lowered for a specific period of time.

System 100 may be provided, in one embodiment as a fully contained unit wherein a vacuum motor, exhaust tube, an air blowing unit, an air intake manifold, a heating element, and related circuitry are all provided and contained within the handle section or portion of system 100. In this case, a hose apparatus illustrated as emanating from the under side of handle section 102 may be assumed to be a vacuum exhaust tube. In another embodiment, handle section 102 may be adapted to contain only the essential circuitry required for powering on the unit and for operation of the unit features while the vacuum motor, air blower, heating element and other components are contained in a connectable floor unit or wall-mounted unit as will be illustrated later in this specification. In this case, the hose apparatus emanating from the underside of handle section 102 may be assumed to be an extension of the double tubular structure of aperture 101.

In one embodiment of the present invention, the temperature sensing results may be fed into an algorithm executed on a central processing unit (CPU) or a micro processing unit (MPU) for the purpose of estimating time required to completely dry hair. Other variables used in time estimation may include initial hair density and condition of dampness. A time estimate may be a rolling estimate that is updateable in real time by applying more or less heat to the application. For example, upon initial heat application at a lower setting, a time estimate for complete dry or set may read EST TIME: 15 minutes whereas an update after 5 minutes into the initial time and after a higher heat setting is applied may read EST TIME: 5 minutes. Therefore, application of intensity (air delivery) and temperature of heat may affect overall time for completing a service.

Customers may, in one embodiment, be enabled to view an ongoing time estimate for completion of a drying or setting on an electronic display provided separately from the system but tethered thereto via data link or wirelessly connected thereto using any number of existing wireless communication technologies. In this case, a customer may elect to provide some input into the process, for example, to help the user decide how much heat to apply for what periods of time.

Hair density and hair condition may differ somewhat from customer to customer and can be quantified in a number of ways using dexterous analysis (feeling; weight estimating), chemical analysis, or other analysis such as quantification of the number of times a subject's hair has already undergone chemical permanent treatments over a given period of time and so on. A professional or even a home-user may assign numerical results to relative hair conditioning found. Likewise, different hair types require different heat and time requirements to achieve similar results in a process. Moreover, a result may include a range of possibility, for example, maximum to minimum curl set, or maximum to minimum hair straightening. Through empirical method and analysis of hair condition and type, current heat and intensity of heat delivery for a specific operation on a specific hair type may be suggested or specified in order to obtain a desired result within a desired time frame.

Figure 2:
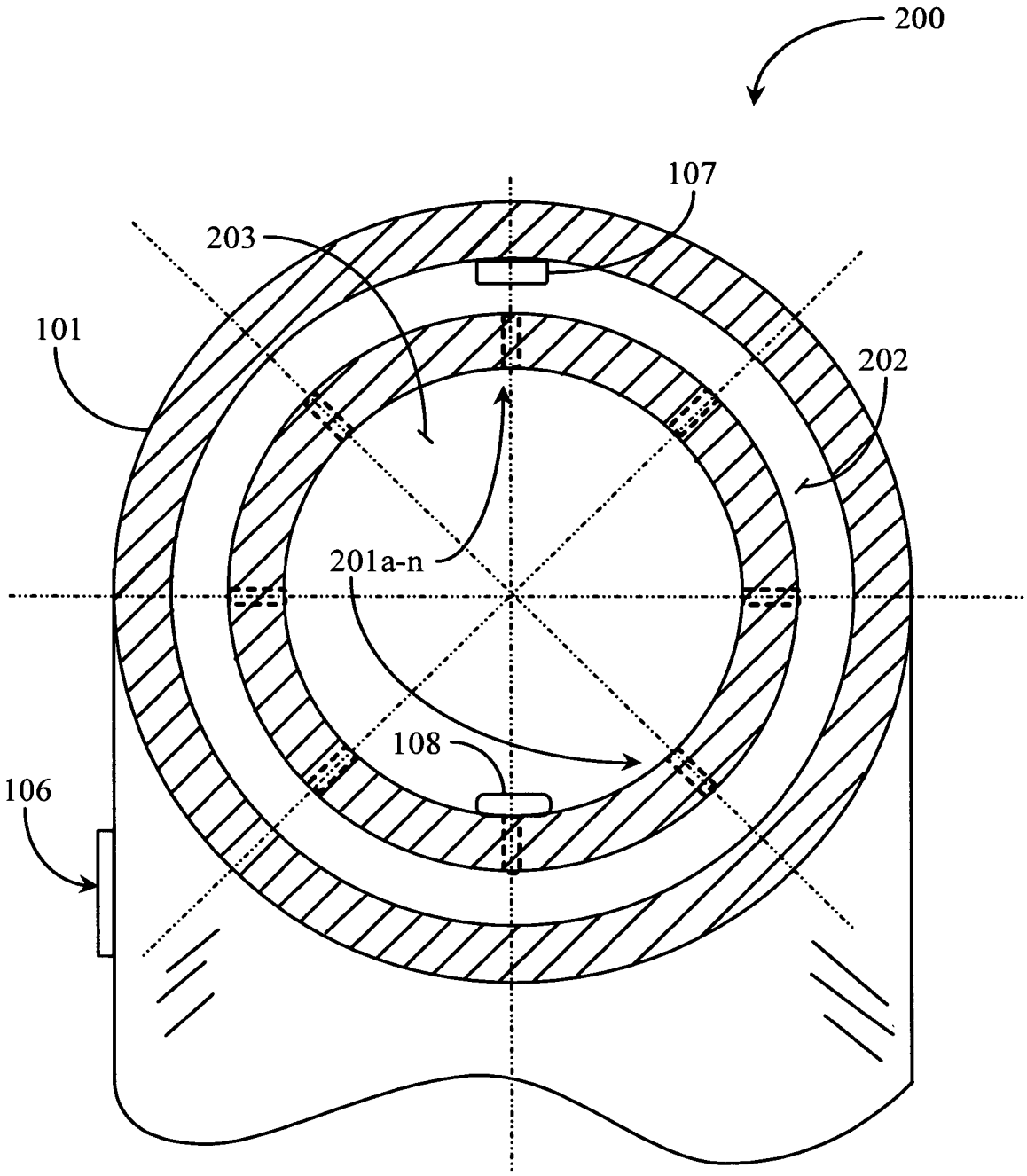
FIG. 2 is a sectioned view of the device of FIG. 1 taken along section lines AA.

FIG. 2 is a sectioned view 200 of device 100 taken along section lines AA of FIG. 1. View 200 illustrates an inner vacuum tubular structure 203 and an outer warm air delivery channel 202. Communication of warm or hot air from channel 202 to inner vacuum tube 203 is accomplished via small openings 201 (*a–n*) strategically placed through the wall surrounding vacuum area 203.

In this example, openings 201 (*a–n*) are located in a symmetrical pattern arraigned in linear array around structure 203 approximately every 45 degrees. However, it should be noted that the specific pattern of openings and shape of aperture 101 is not required in order to practice the present invention. Aperture 101 may assume a rectangular form or an elliptical form without departing from the spirit and scope of the present invention. In this embodiment, the outer wall-enclosing channel 202 is a semi-rigid material and aperture 101 assumes a double-walled construction. This is not specifically required in order to practice the present invention. An alternate construction that may be provided in place of or as an attachment to aperture 101 will be described later in this specification.

In view 200, temperature sensing and reporting devices 107 (channel 202) and 108 (vacuum area 203) are visibly located substantially at 0 degree positions at vertical axis points. This should not be construed as a limitation. In practice there may be more than one of each sensing device and they may be placed anywhere within their respective channels without departing from the spirit and scope of the present invention. For example, there may be 4 devices 107 arraigned at 0 and at 90-degree locations. There may be 4 devices 109 similarly arraigned. Arrangement patterns may be offset in terms of degree from one another and varying numbers of sensing devices may be provided. Likewise, placement of sensing devices 108 may be ordered in a fashion that maximally distances them from any of openings 201 (*a–n*) so that a more accurate average temperature for the vacuum area 203 may be calculated. There are many possibilities.

In practice of the present invention, a subject's hair is disposed within vacuum area 203 when the system is in operation with vacuum power on. Warm or hot air is then measurably delivered through channel or jacket 202 and is introduced into vacuum area 203 through openings 201 (*a–n*). In this way hair disposed within vacuum area 203 is efficiently dried or set.

In one embodiment, further accessories of varying designs and purposes may be contemplated and provided for accomplishing certain hair-styling tasks such as curling or spiraling hair. For example, an elongated and spiral formed hair setting accessory may be provided to accept a subject's hair formed while wet about the spiral construction of the accessory. The elongated shape of the accessory enables disposition thereof into the vacuum area 203 while it is attached to a subject's hair. When setting is complete the accessory is removed and hair retains the spiral curl configuration to conformity controllable by heat selection and intensity of delivery of the heat into the vacuum area for a period of time discernable, in one embodiment, by algorithmic function as described further above.

Figure 3:
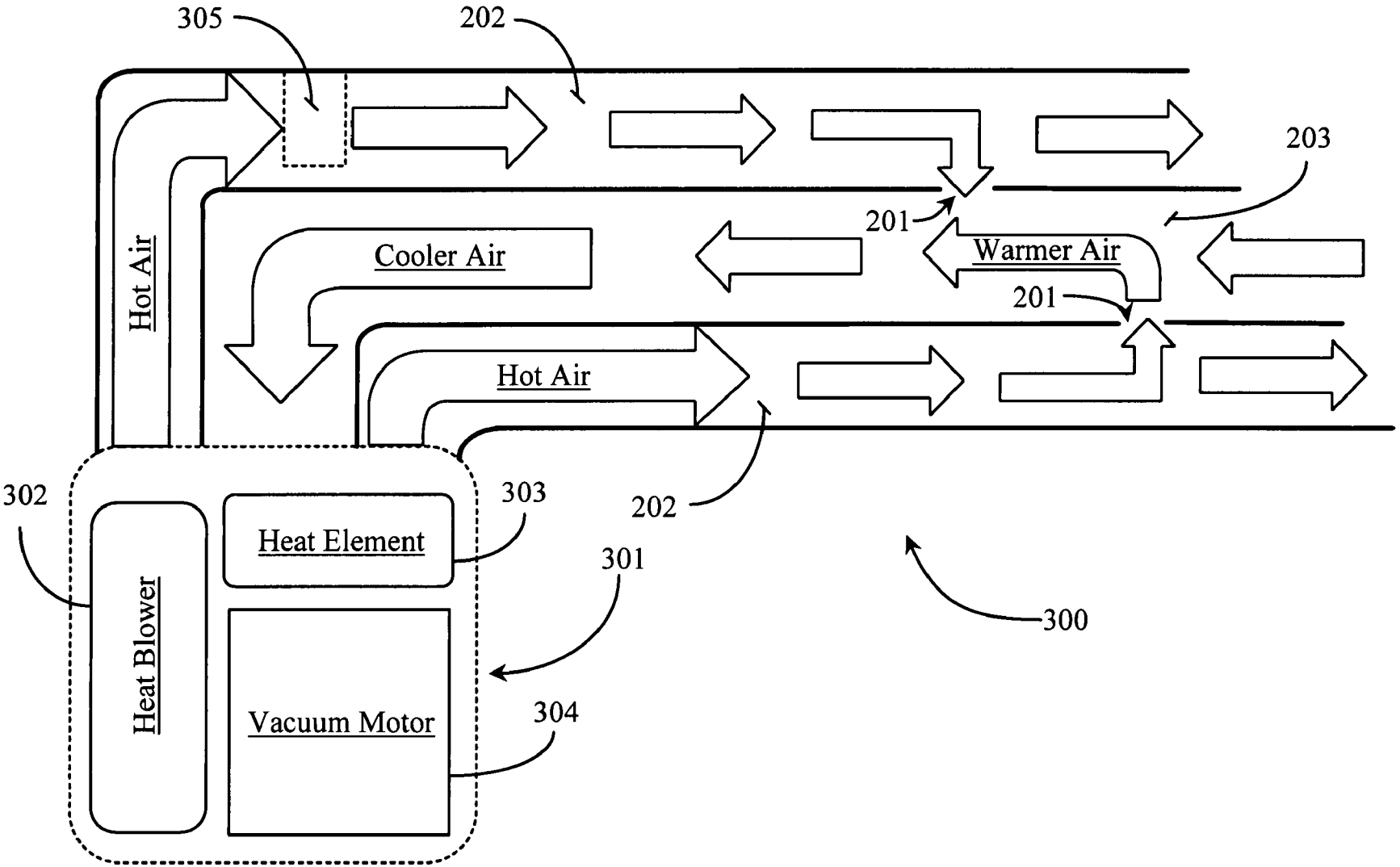
FIG. 3 is a block diagram 300 illustrating airflows and temperature-sensing units of the device of FIG. 1.

FIG. 3 is a block diagram 300 illustrating airflows and temperature-sensing units of device 100. Device 100 may be adapted as a standalone hand-held device in one embodiment. A handle portion 301, analogous in one embodiment to handle section 102 described with respect to FIG. 1 above, contains a vacuum motor 304, a heat blower 302, and a heating element 303. Vacuum motor 304 is adapted in this example to create a stream of air flowing through inner vacuum space 203 when powered on. A reverse blower or fan may be used to accomplish this task. Cooler air then flows briskly in the direction of the arrow labeled same. This action causes a subject's hair to be disposed within area 203 for treatment.

Heat element 303 is powered on when blower 302 is powered on, both of which may be adapted to more than one setting combining heat and force of delivery. In one embodiment heat in the form of a brisk stream of warm or hot air is forced into channel 202 as illustrated by an arrow labeled hot air and communicates with area 203 through openings 201, thus mixing with a subject's hair disposed therein. Upon communication with cooler air, the hot air acts to heat or warm the cooler air enabling measured introduction of heat for hair drying and setting. Handle section 301 may be provided with a vacuum exhaust outlet (not illustrated) similar to the hose projection on handle section 102 described with reference to FIG. 1 in a stand-alone embodiment. Similarly, an air intake manifold may be provided to enable a source of incoming air for heating element 303 and blower 302.

Each motor controlling each airflow may be provided having sufficient power capabilities to create relatively brisk airflows in the adapted directions and may be powered using alternating current or direct current. As such, a standalone device may derive power from a standard electrical outlet or a rechargeable battery source.

In an alternative embodiment of the invention there may be no forced air blower for urging air over the heating element or elements. Rather there may be one or more openings upstream from the heating element or elements, and the action of the vacuum source may create a pressure differential through openings 201 to draw air over the heating elements and then through openings 201 into space 203.

Figure 4:
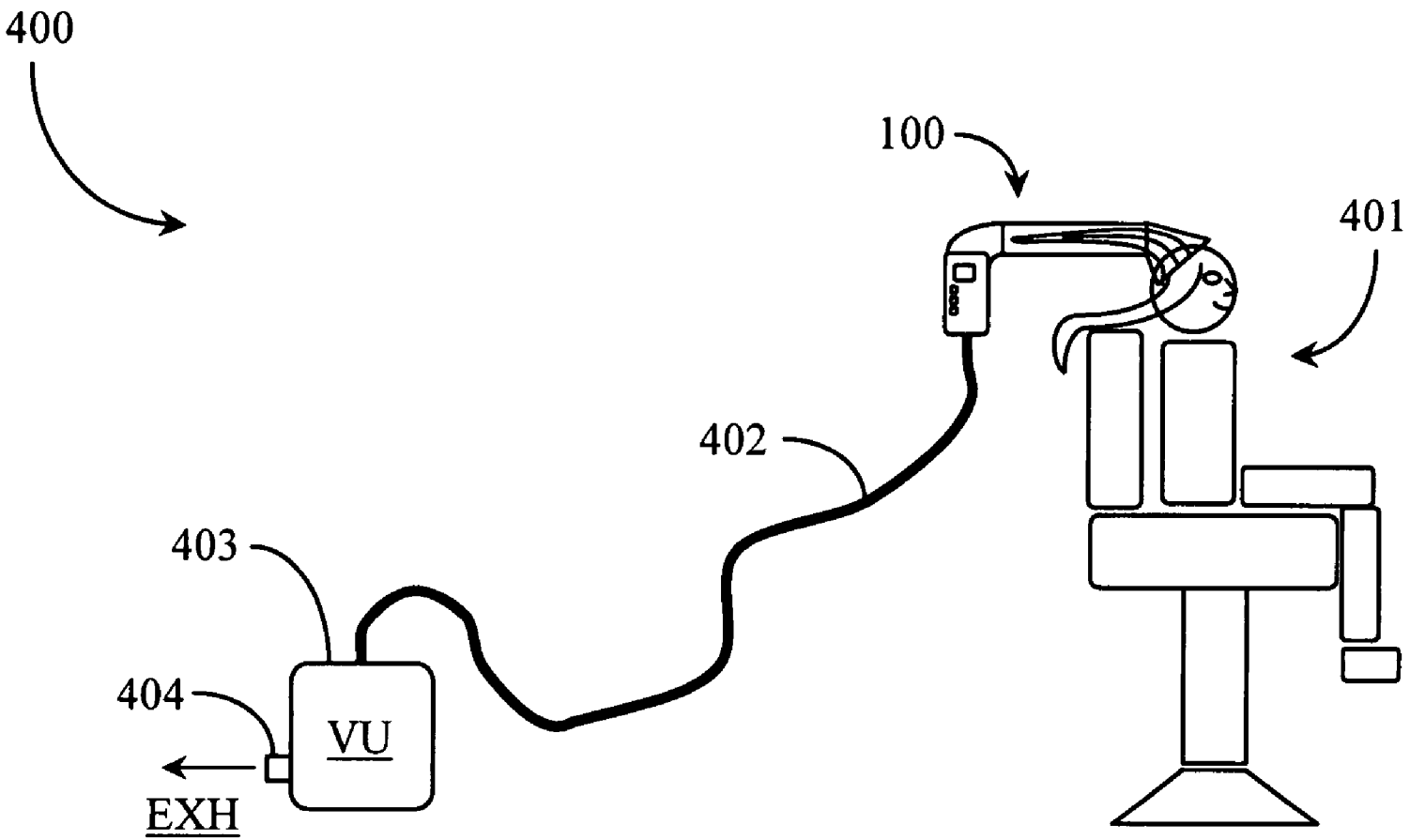
FIG. 4 is a plan view of shop connectivity of the device of FIG. 1 according to an embodiment of the present invention.

FIG. 4 is a plan view 400 of shop connectivity of device 100 according to an embodiment of the present invention. In view 400, device 100 has connection to a floor-based vacuum unit (VU) 403 via a vacuum hose 402. VU 403 is adapted to create a powerful airflow through the inner channel of device 100 such that all or a selected portion of hair of subject 401 is forcible disposed into the tube. In this example, a vacuum exhaust port 404 is provided on VU 403. In this embodiment, heating apparatus and blower apparatus for creating and delivering hot air is still contained in the handle portion of unit 100. In this way heated air remains maximally hot for delivery to system 100.

In one embodiment, the funnel portion of device 100 is an attachment that is replaceable with attachments of similar description but of varying sizes, such as for example a larger or smaller funnel for accommodation of both adults and children. As an attachment or as a permanent fixture, the funnel portion may be adapted with a certain range of ratability or flexibility for assumption of a range of positions. In one embodiment only selected amounts of hair from subject 401 may be disposed within device 100 during operation. In another embodiment, device 100 may accommodate all or most all of the hair of subject 401 during treatment. The amount of hair disposed within device 100 during operation will depend on the type of operation, style parameters, and other possible conditions and variables including whether further accessories are being used and so on.

Figure 5:
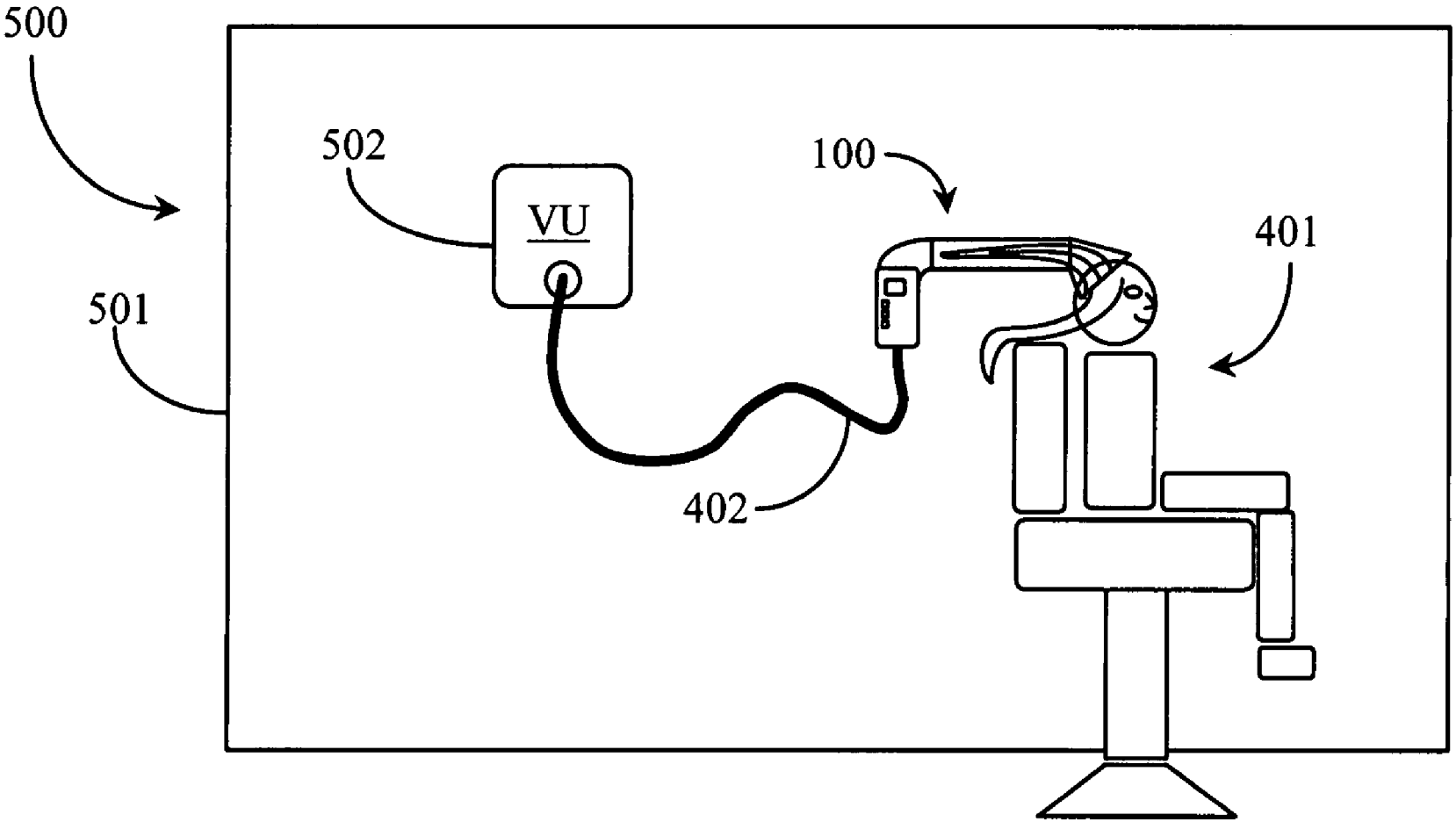
FIG. 5 is a plan view of shop connectivity of the device of FIG. 1 according to another embodiment of the present invention.

FIG. 5 is a plan view 500 of shop connectivity of device 100 according to another embodiment of the present invention. In view 500, device 100 has connection to a vacuum unit (VU) 502 via vacuum hose 402. VU 502 is adapted as a wall-mounted unit mounted to a wall 501 near where subject 401 is seated and being serviced. In case of a wall mounted VU scenario, the exhaust from the vacuum airflow may be adapted to exit through an interior channel or pipe built into the wall itself. In a case of many systems in operation such as in a beauty salon, multiple wall-mounted VUs may share a common exhaust system eventually exiting the building through a convenient outlet.

One advantage of the system of the present invention is that for all applications and for scenarios wherein multiple devices 100 are being operated, excessive blowing of air around subjects being serviced is not a factor. Conventional noise-reduction techniques and apparatus may also be employed to reduce vacuum motor and heat blower noise.

Referring now back to FIG. 3 according to a further embodiment of the present invention, scent provided through a solid, semi-solid, or powder medium may be delivered into channel 202 through provision of one or more permeable compartments 305 provided in the path of the hot air flowing through the channel. Device 100 may be provided with such compartments 305 into which blocks of scented material (not illustrated) may be placed. The action of hot air flowing through such a compartment loaded with a scent block functions to dislodge scent molecules from the block and carry them into channel 203 through openings 201 wherein the scent molecules become attached or intersperse with a subject's hair being treated thus impregnating the treated hair with the desired scent. There may be a wide variety of different scents made available. Likewise, other hair treatment mixtures like coloring and conditioners may be dispensed into the vacuum chamber at appropriate process time-points by dispenser apparatus provided and adapted for the purpose.

Figure 6A:
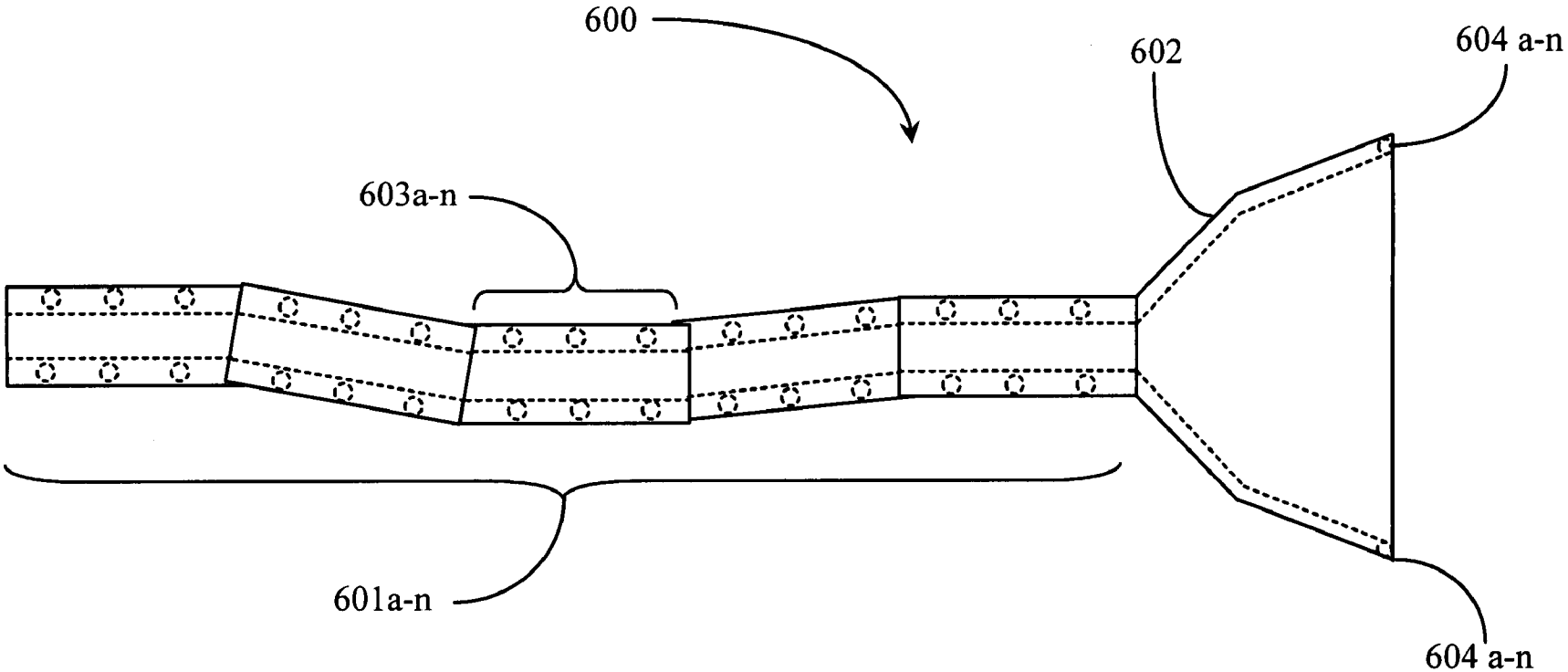
FIG. 6A is a plan view of a hair-drying attachment connectable to the device of FIG. 1 according to an embodiment of the present invention.

FIG. 6A is a plan view of a hair-drying attachment 600 connectable to device 100 according to an embodiment of the present invention. Attachment 600 is provided of a different configuration than was described with respect to aperture 101 described with reference to FIG. 1. Attachment 600 may, in one embodiment, replace aperture 101 as one preferred form for providing vacuum function with hot air injection capabilities.

Attachment 600 may comprise a plurality of semi-rigid sections 601 *a–n*, which may be removably attached together to form a semi-flexible structure or aperture of rectangular proportions and of a desired length for treating a particular length of hair of a subject. Likewise, a funnel 602 may also be provided as an end attachment wherein the attaching end assumes the rectangular form and the open end assumes a more annular funnel shape. Funnel 602 may be semi-flexible and may also be rotably adapted to assume a range of direction as was described with reference to funnel 103 of FIG. 1.

In this embodiment, each section 601 *a–n* has an inner vacuum channel or jacket and one or more outer channels or jackets for delivery of warm or hot air somewhat similar to the embodiment of FIG. 3 described further above, but with some design differences. Similar to aperture 101, a plurality of small openings 603 *a–n* is provided for communicating warm or hot air into the interior vacuum space. Openings 603 *a–n* may be extended in location into funnel 602 and may also be provided substantially on the outer rim of funnel 602 illustrated herein by openings 604*a–n*. Openings 604 *a–n* are adapted to enable some warmer air to make contact with the immediate area of a subject's scalp so that a measure of comfort may be provided during treatment as opposed to a sensation of cold being perceived by the subject at the area covered by funnel 602.

Sections 601 *a–n* may be provided of the form of a semi-rigid polymer fabricated by molding or other similar manufacturing method. One or more permeable scent compartments such as compartment 305 describe with reference to FIG. 3 may also be provided to one or more segments 601 *a–n* for enabling scent to be delivered to a subject's hair along with heat. Providing attachment 600 in a rectangular tubing configuration provides some distinct advantages over a more annular construction as will be described below.

Figure 6B:
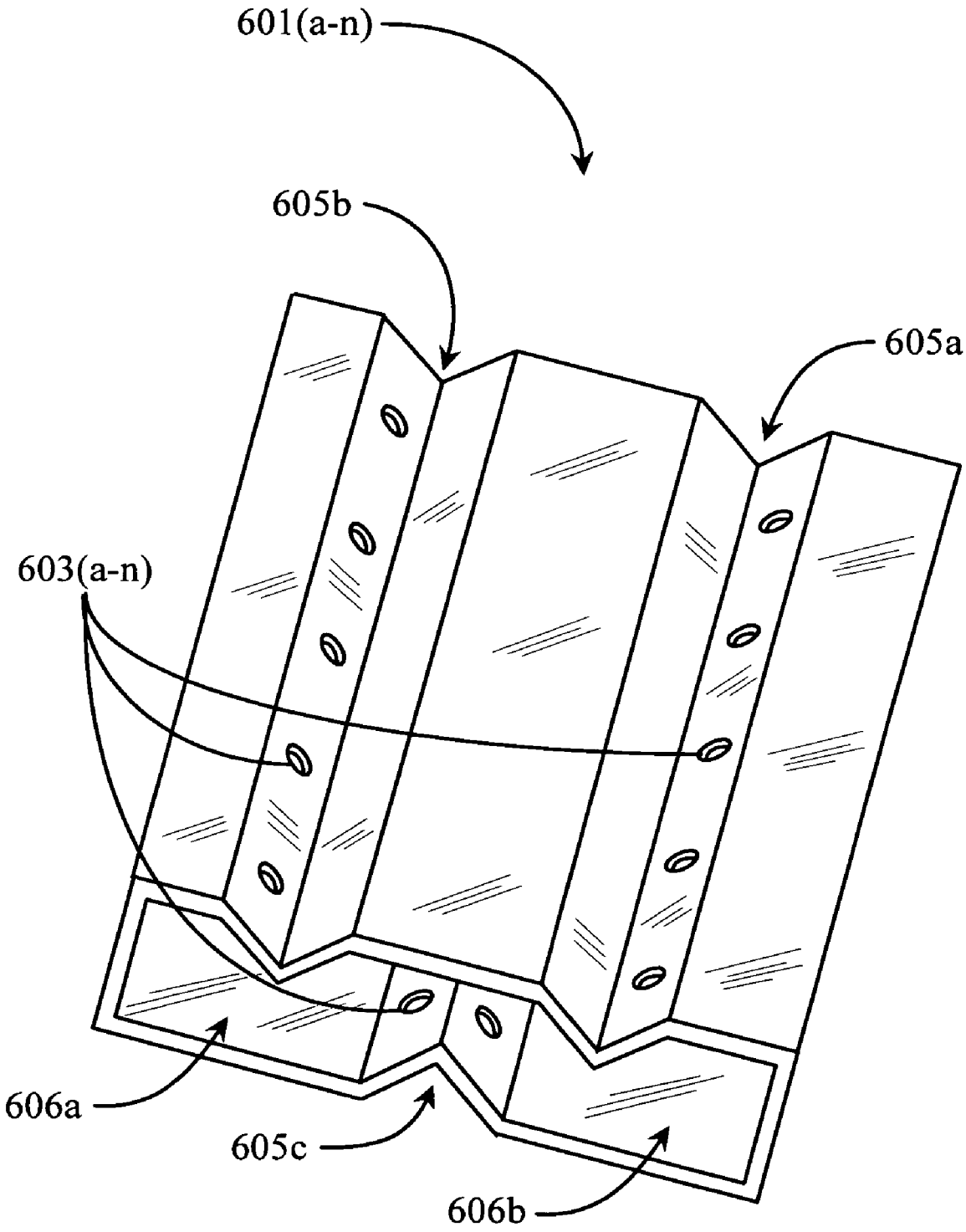
FIG. 6B is a perspective view of one of the multiple segments of the device of FIG. 6A.

FIG. 6B is a perspective view of one of segments 601 (*a–n*) of FIG. 6A. Segment 601 has an inner vacuum space, which is physically divided into two proportional vacuum spaces 606*a* and 606*b*. The space is divided by a V-shaped channel 605*c*. On the upper surface of segment 601, a V-shaped channel 605*a* and a V-shaped channel 605*b* are similarly provided. Channels 605*a–c* are formed longitudinally into segment 601 in substantial parallel arrangement with a longitudinal centerline thereof V-shaped channels 605*a–c* may be formed into the surface of segment 601 during a molding process to fabricate the segment.

In this example, segment 601 has a preferred upper portion or surface and a preferred lower portion of surface. The upper portion has channels 605*a* and 605*b* while the lower surface contains only channel 605*c*. Channels 605 *a–c* are, in this embodiment, adapted as seats for physically accepting and retaining hot air hose sections (not illustrated). In this example, there is no unified single outer channel for hot air delivery, rather the hot air is delivered through separate hose sections that are adapted to seat in conformity within channels 605*a–c*. The hose sections, are illustrated further below may be adapted with valve stem apertures, through which hot air may flow and which may be disposed longitudinally along each hose section in a linearly spaced arrangement that enables the hose sections to be snapped into place using the openings as valve seats.

In this example, openings 603 *a–n* are strategically located along each channel 605*a–c* in linear arrangement. However, with respect to channels 605*a* and 605*b* located along the upper surface of segment 601 only the far-opposed channel walls contain the openings. Channel 605*c*, unlike channels 605*a* and 605*b* has openings placed through both channel walls. Therefore, a hose section with valve apertures in a single linear arrangement would seat in either channel 605*a* or 605*b* whereas a hose section used for channel 605*c* would have two rows of valve stem apertures to fully accommodate the two linear arrays of openings provided.

In practice of the present invention, using segment 601, a subject's hair is disposed into vacuum areas 606*a* and 606*b* in a manner that divides and flattens the subjects hair along the surface containing channel 605*c*. Channel 605*c* helps to divide and spread the amount of hair somewhat evenly throughout the combined vacuum area. Small openings 603 in both walls of V-shaped channel 605*c* enable warm or hot air from the seated hose sections to dry hair from the inside toward the outer edges. The openings 603 in V-shaped channels 605*a* and 605*b* enable warm or hot air to focus more on the top outer perimeters of the amount of hair disposed into the combined vacuum area.

In this example, the rectangular construction and strategic placement of openings in segment 601 provides for a more evenly distributed source of heat or hot air for drying and setting. In the annular configuration described further above, hair occupying the center portion of the inner tubular structure may not get as much heat in a same time period as the hair occupying the periphery of the structure.

Figure 7A:
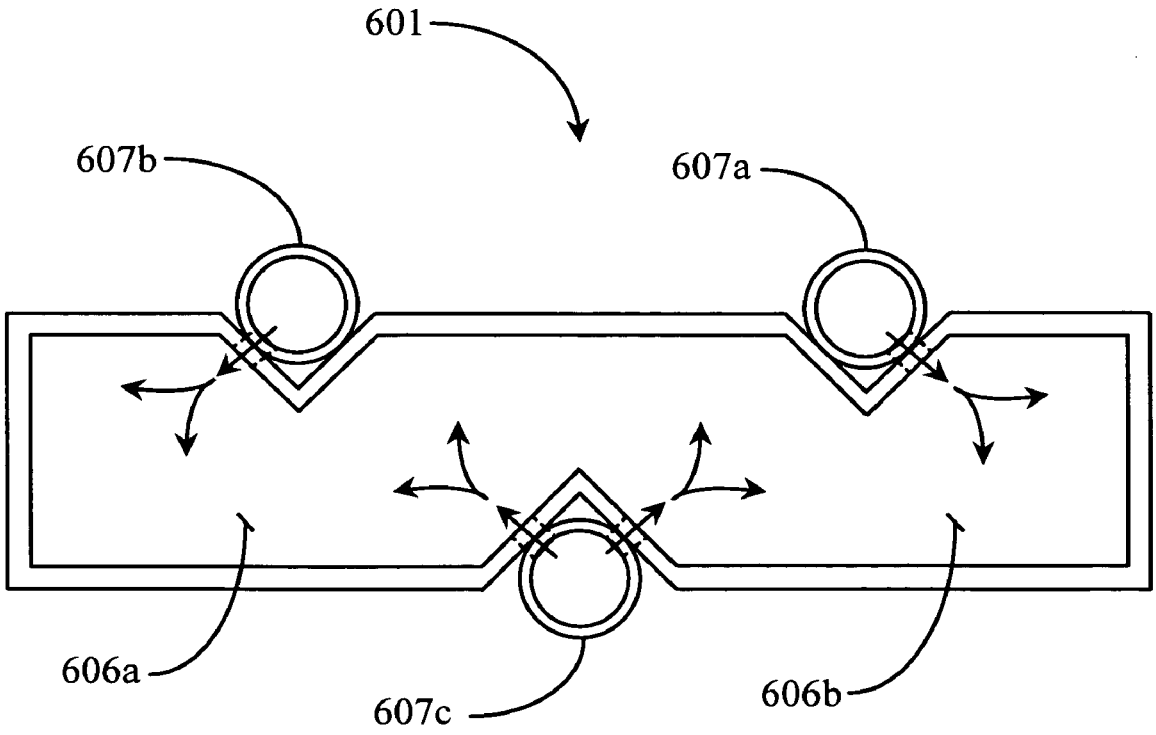
FIG. 7A is an end view of the segment of FIG. 6B illustrating optional integration therewith of hot air injection tubes according to an embodiment of the present invention.

FIG. 7A is an end view of segment 601 illustrating optional integration therewith of hot air hose sections 607 (*a–c*)) according to an embodiment of the present invention. In this example, segment 601 is illustrated with optional heat delivery hose sections 607 (*a–c*) installed in place along their respective V-shaped channels. Hose sections 607*a–c* may be provided in the form of a heat-resistant polymer flex tubing having apertures that are designed to fit the openings along the channel wall in the fashion of an injection manifold. Therefore, hose section 607*a* delivers hot air through the openings in the general direction of the arrows accommodating the outer and upper surface of a subject's hair on the right side (facing the drawing). Hose section 607*b* delivers a separate stream of hot air through the openings in the general direction of the arrows accommodating the outer and upper surface of a subject's hair on the left side. Hose section 607*c* is adapted to seat using two linear arrays of apertures that are positioned over and then snapped into the openings. Hose section 607*c* delivers hot air through the openings in the general direction of the arrows accommodating the inner and under surfaces of a subject's hair from the point of division by channel 605*c*.

In this embodiment, hose section 607*a–c* may converge into a single hose on the end that connects to the heat source thus enabling an equal provision of hot air through each section and channel. Each hose section 607*a–c* may be adapted to deliver scent along with hot air as was previously described through the provision of a permeable compartment containing a scent producing substance further back along the hot air route past where the individual hose sections converge into a single hose section that connects to the heat source blower. In this case the permeable compartment might be provided at the connection of the hose and blower.

Figure 7B:
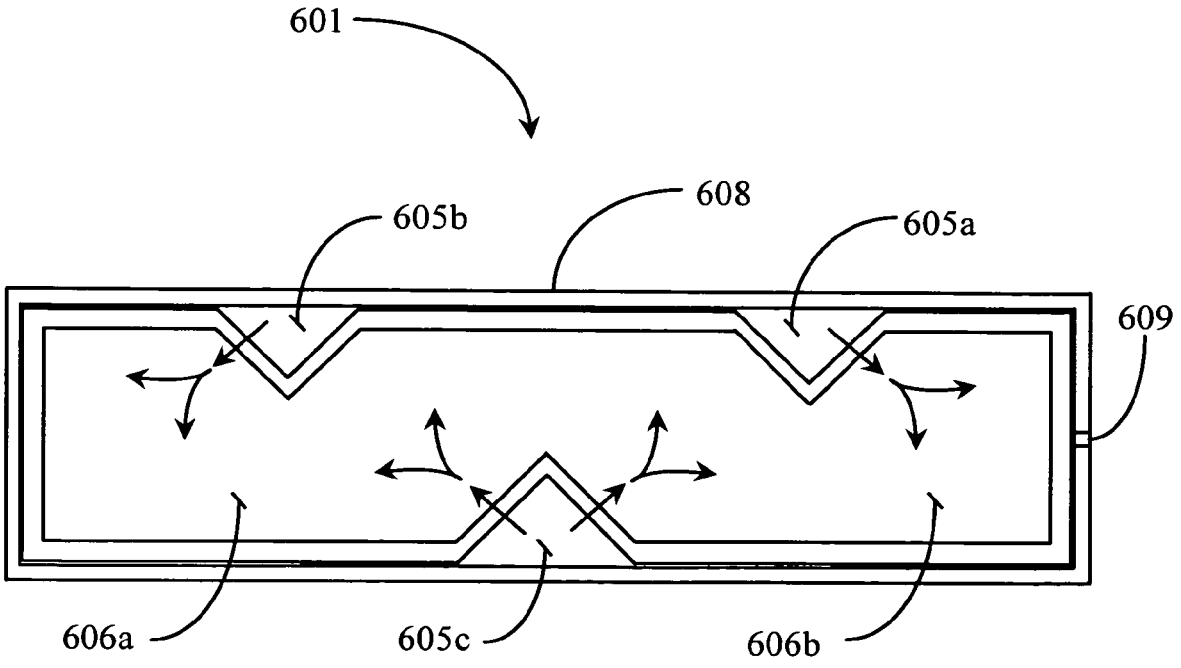
FIG. 7B is an end view of the hair-drying attachment of FIG. 6A illustrating an optional hot air jacket according to an embodiment of the present invention.

FIG. 7B is an end view of segment 601 illustrating an optional hot air jacket 608 according to another embodiment of the present invention. Segment 601 may be adapted to accept hot air jacket or sleeve 608 instead of providing separate hose sections that seat into the previously described V-shaped channels 605*a–c*. Jacket 608 may be fabricated as a flexible rubber or polymer sleeve that extends the length of multiple segments 601 that are snapped together. A separable seam 609, which may be closed via a zipper mechanism or a zipper lock arrangement similar to a common zip-lock polymer bag, may facilitate application of jacket 608 over the individual segments 601(*a–n*). In this way, hot air flow may be introduced in the same manner as hose section application producing the same equalized flow of hot air according to the direction of the arrows illustrated.

In this embodiment, the back-end connection to the heat and vacuum source may retain a rectangular configuration or may graduate from a first segment 601*a* to a more annular shape by provision of a connector adapter, which may take the form of a semi-rigid molded piece.

Figure 8:
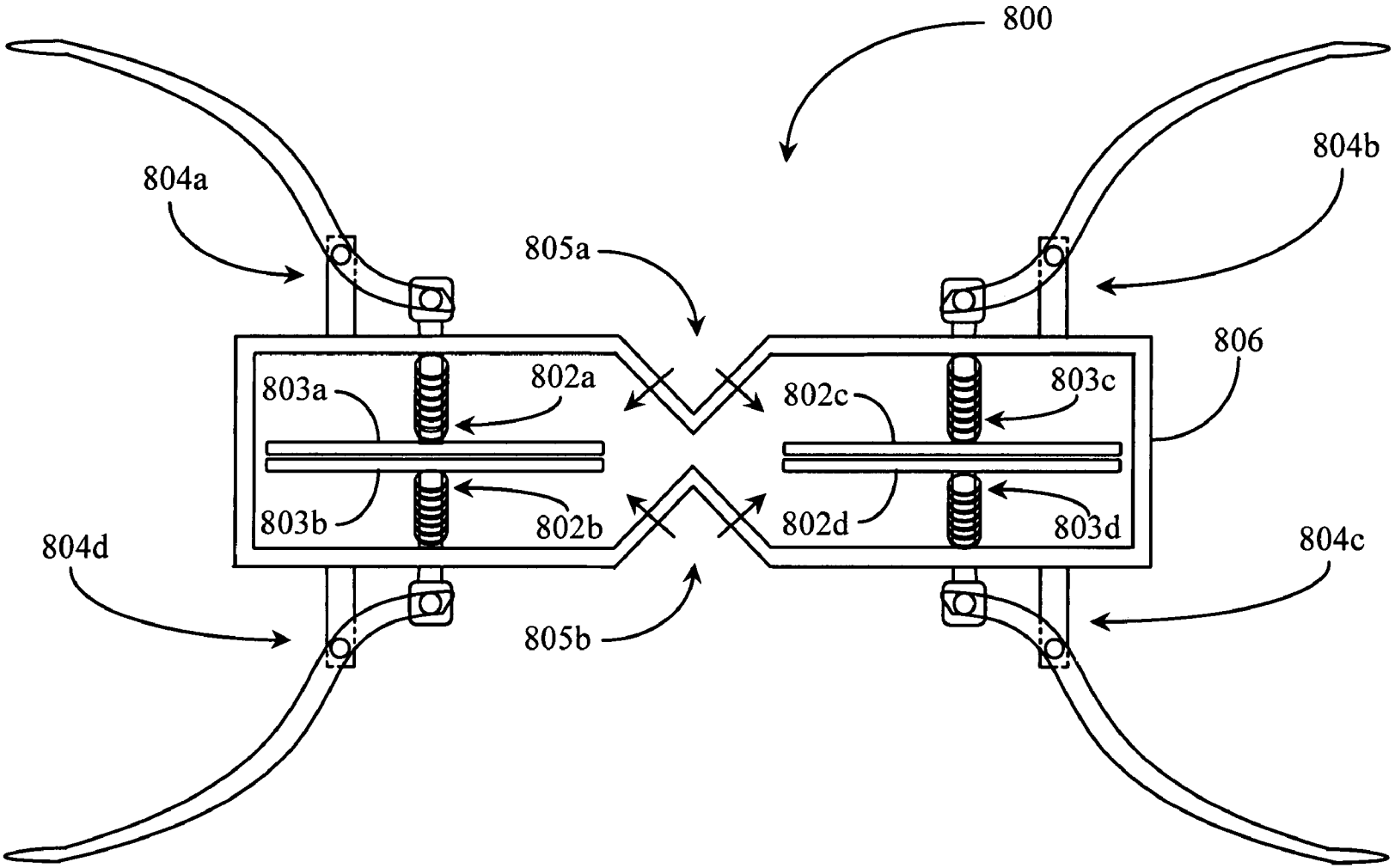
FIG. 8 is an end view of a hair-straightening device that may be connected as an end attachment to the device of FIG. 1 or to the device of FIG. 6A according to an embodiment of the present invention.

FIG. 8 is an end view of a hair-straightening device 800 that may be connected as an end attachment to device 100 or to device 600 according to an embodiment of the present invention. Hair-straightening device 800 has a same general shape and dimension as any one of segments 601(*a–n*) described with reference to FIGS. 7A and 7B above with exception to channel configuration. Device 800 may be formed of a more rigid polymer 806 than flexible segments 601. Device 800 is adapted to be used as an end piece through which a subject's hair is disposed therein in a vacuum area as previously described.

Device 800 is enabled to straighten hair via provision of opposable plates 803*a* and 803*b* on one side of a V-shaped channel configuration comprising a V-shaped channel 805*a* and a V-shaped channel 805*b*. On the remaining side are opposing plates 802*c* and 802*d*. Plates 803*a–d* may be provided of the form of a stainless steel plate cut to dimension and having a thickness thereof to facilitate and support a press load force exerted against one another in each opposing configuration. Each plate may also, in one embodiment, be covered or sheathed with a cloth like material at least on the opposing surfaces, which may be optionally dampened with a special solution that may aid in hair straightening.

Each opposing plate is rigidly attached to a solid connector rod and spring assembly illustrated herein as rod and spring assemblies 802*a*–802*d*. The method of attachment may be rivet, nut and bolt, sheet metal screw, or welding. There are many possibilities.

In this embodiment, each connector rod extends through the wall 806 of device 800 in a manner as to enable slidable movement of each pair of plates away from each other but maintaining retention of the associated springs placed over each rod within the device seating against their respective plates and against the inner surface of wall 806. At the ends opposite plates 803*a–d*, each rod 802*a–d* has an axel hub formed thereon that accepts rotable attachment of the forward end of a lever assembly illustrated herein as lever assemblies 804*a–d*. Lever assemblies 804 *a–d* may comprise at least one rigid fulcrum, which may be formed contiguously using the same rigid polymer material-defining segment 806. The fulcrums may be provided with a horizontally positioned axel pin adapted to extend through and retain the lever of each assembly at a convenient fulcrum point behind the forward end of each lever. Each lever is rotable fitted around its axel such that lever action functions to raise each plate 803*a–d* against a spring load force away from the respective opposing plate 803*a–d*.

In this embodiment, each lever assembly 804*a–d* has a respective opposing lever assembly 804*a–d*, which in paired configuration is adapted to accept force applied by a user's hand to actuate the levers toward one another thereby raising the associated plates away from each other against spring load. In this position of applied force, the levers may be locked into position using individual locking mechanisms or a shared locking mechanism between a pair of levers in order to retain maximum space between opposing plates, for example, plates 803*a* and 803*b* and plates 802*c* and 802*d*. In raised position, a subject's hair may be disposed within the internal vacuum area between plates.

Release of the locking mechanism used or simply disengagement of applied manual force on opposing lever assemblies forces the opposing plates together under spring load. A subject's hair may be slowly pulled through the closed plates while heat is applied through a channel 805*a* and a channel 805*b* using the previously described hose section method or the described hot air jacket embodiment to deliver the hot air according to the general direction of the arrows.

In one embodiment of the present invention, wall 806 may have rectangular depressions formed therein at the plate locations enabling each plate 803*a–d* to recess into wall 806 to an extent that a subject's hair when disposed into the interior of device 800 does not enter under or become entangled with the underside of a plate or spring assembly. Raises or ridge walls may also be formed for the purpose. Spring assemblies 802*a–d* may also be covered with rubber boots so that any loose hair does not become entangled therein during straightening.

In practice of the present invention using device 800, a portion of or all of a subject's hair for straightening is disposed into the interior vacuum area of device 800 with the vacuum power on and with force applied to lever assemblies 804*a–d* such that the hair disposed therein assumes a position in between plates 803*a–d*. Channel 805*b* functions to separate hair and hot air entering through channels 805*a* and 805*b* acts to gather hair over the raised plates. If desired the plates may be treated with a straightening solution prior to hair disposition within the vacuum area.

At a predefined time such as when temperature is adequate, the force applied to raise plates 803*a–d* is discontinued and the close against each other under spring load trapping the subject's hair there between. At this point the hair may be slowly pulled out of device 800 to straighten the entire length or portion of length which ever is ordered. Raising the plates again and inserting the same lock or new portion of the subject's hair may precede a second straightening process and so on until the desired condition of straightness is achieved for all of the hair portions to be straightened.

It will be clear to one with skill in the art of manufactured devices that there are other ways to implement a hair straightening mechanism within device 800 than that illustrated in this example. In one application, instead of two opposing plates, hair is straightened against wall 806 using only one plate and spring assembly. In another example, instead of levers, plunger assemblies are provided. In still another example, the plates are affixed directly to the opposing wall structures of the vacuum chamber and the rectangular tubing structure is flexible to a point that enables the plates to be pressed together over a client's hair by hand using no other mechanical aids. The exact mechanism illustrated in this example should not be construed as a limitation.

The present invention may be provided in the configurations and forms described using a combination of fewer than or all of the components and features illustrated without departing from the spirit and scope of the present invention. The present invention may be provided in various forms and capacities for industrial use and for home use without departing from the spirit and scope of the present invention. Similarly accessories may be contemplated and devised that utilize the broad features of the present invention in provision of more narrowly defined features or functions like hair straightening, hair shaping and hair curling and like operations that use heat and air flow to effect results. The present invention provides a method for styling and shaping hair, particularly longer hair that enables a more flexible and measurable approach over prior art systems in place. Therefore the methods and apparatus of the present invention should be limited only by the claims that are appended to this specification below.

What is claimed is:

1. A hair drying and shaping system comprising:

a vacuum channel connected to a vacuum source for containing hair disposed therein for treatment;

a hot air channel connected to a hot air source and having communication with the vacuum channel for measurable delivery of heated air into the vacuum channel; and a control interface for determining, setting, and activating features and parameters thereof during operation.

2. The system of claim 1 wherein the vacuum and hot air channels are aligned and facilitate respective airflows in a substantially opposing direction.

3. The system of claim 1 wherein the vacuum channel and hot air channel are formed as a double-walled tubular construction defining the vacuum channel surrounded by the hot air channel.

4. The system of claim 1 wherein the vacuum source is a motor and fan creating airflow of ambient air directed away from a subject.

5. The system of claim 1 wherein the vacuum source and the hot air source are contained in a handle portion of the system and wherein the system is a hand-held device.

6. The system of claim 1 wherein the vacuum source is contained in a floor canister connected to a hand-held portion of the system by a vacuum hose.

7. The system of claim 1 wherein the vacuum source is contained in a wall-mounted canister connected to a hand-held portion of the system by a vacuum hose.

8. The system of claim 1 wherein the vacuum channel and hot air channel are contained in an annular tubular structure.

9. The system of claim 1 wherein the vacuum channel and hot air channel are contained in a rectangular tubular structure.

10. The system of claim 1 wherein the hot air channel is defined as a delivery system of separate hose sections interfacing with the vacuum channel via openings placed there through and openings placed through the hose sections.

11. The system of claim 1 wherein the hot air channel is defined as a delivery system comprising one or more V-shaped channels encased by a flexible jacket, the hot air delivered into the V-shaped channels.

12. The system of claim 1 further comprising:

at least one temperature sensing device communicating with the vacuum channel for reporting current temperature of the air therein during operation; and at least one temperature sensing device communicating with the hot air channel for reporting current temperature of the air therein during operation.

13. The system of claim 12 further comprising:

a processor running an algorithm for estimation and reporting of process time left, reportable at any point in time using results from temperature sensing and considering input variables related to process description, hair type, and hair condition.

14. The system of claim 13 further comprising:

a peripheral display connected by data link or wireless communication link to the system, the display enabling client viewing of estimated time left at any point in time of a process being performed.

15. The system of claim 1 further comprising at least one permeable and externally accessible compartment affixed to a position inline with hot air flow, the compartment containing a scented material for dispensing into the vacuum chamber.

16. The system of claim 15 wherein the contained material is a hair conditioning material.

* * * * *

US007093376C1

(12) EX PARTE REEXAMINATION CERTIFICATE (9890th)

United States Patent
Regen

(10) Number: US 7,093,376 C1
(45) Certificate Issued: Oct. 21, 2013

(54) HAIR DRYING AND SHAPING SYSTEM

(75) Inventor: Paul Regen, Felton, CA (US)

(73) Assignee: Ennova Direct, Inc., Santa Cruz, CA (US)

Reexamination Request:
No. 90/012,620, Sep. 14, 2012

Reexamination Certificate for:

| | |
|---|---|
| Patent No.: | **7,093,376** |
| Issued: | **Aug. 22, 2006** |
| Appl. No.: | **10/969,154** |
| Filed: | **Oct. 19, 2004** |

(51) Int. Cl.
*A45D 20/12* (2006.01)

(52) U.S. Cl.
USPC ..... 34/96; 132/200; 392/384

(58) Field of Classification Search
None
See application file for complete search history.

(56) References Cited

To view the complete listing of prior art documents cited during the proceeding for Reexamination Control Number 90/012,620, please refer to the USPTO's public Patent Application Information Retrieval (PAIR) system under the Display References tab.

*Primary Examiner* — Patricia Engle

(57) ABSTRACT

A hair drying and shaping system is provided and has a vacuum channel connected to a vacuum source for containing hair disposed therein for treatment; a hot air channel connected to a hot air source and having communication with the vacuum channel for measurable delivery of heated air into the vacuum channel; and a control interface for determining, setting, and activating features and parameters thereof during operation.

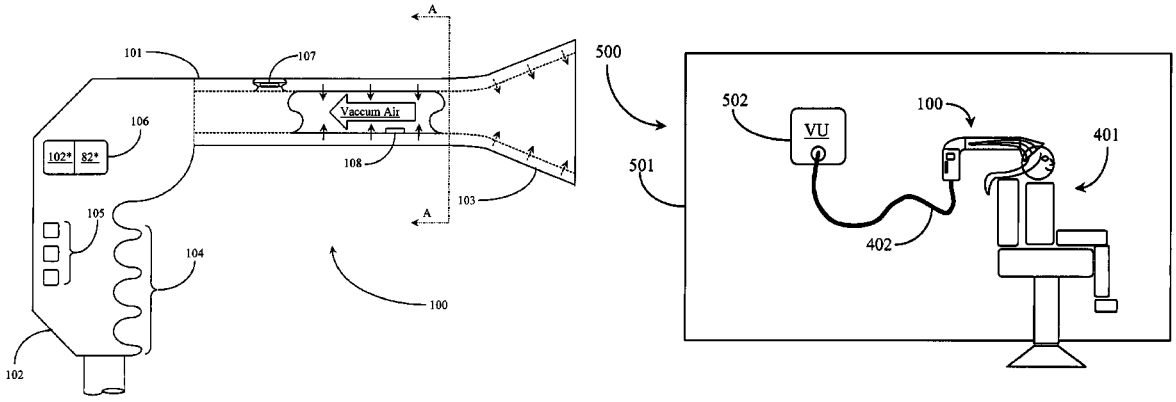

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-8 and 12 are cancelled.

Claim 10 is determined to be patentable as amended.

New claims 17-23 are added and determined to be patentable.

Claims 9, 11 and 13-16 were not reexamined.

10. [The system of claim 1] *A hair drying and shaping system comprising:*

*a vacuum channel connected to a vacuum source, the vacuum channel having a substantially rectangular or oval shape in cross-section with a width substantially greater than a height;*

*a hot air channel connected to a hot air source and having communication with the vacuum channel for delivery of heated air into the vacuum channel;*

*and a control interface for determining, setting, and activating features and parameters thereof during operation;* wherein the hot air channel is defined as a delivery system of separate hose sections interfacing with the vacuum channel via openings placed there through and openings placed through the hose sections.

*17. A hair drying and shaping system comprising:*

*a vacuum channel having a length and a constant diameter over a first portion of the length for containing hair disposed therein for treatment, the vacuum channel connected at one end to a vacuum source and open at the opposite end, the open end having a conical shape expanding the diameter over a second portion of the length toward the open end;*

*a hot air channel connected to a hot air source and having communication with the vacuum channel for delivery of heated air into the vacuum channel; and*

*a control interface for determining, setting, and activating features and parameters thereof during operation.*

*18. A hair drying and shaping system comprising:*

*a vacuum channel connected to a vacuum source, the vacuum channel having a substantially rectangular or oval shape in cross-section with a width substantially greater than a height;*

*a hot air channel connected to a hot air source and having communication with the vacuum channel for delivery of heated air into the vacuum channel; and*

*a control interface for determining, setting, and activating features and parameters thereof during operation;*

*wherein the vacuum channel has an inner wall and a length, and further comprising one or more vertical extensions from the inner wall, the one or more vertical extensions extending also along the direction of air flow in the channel for a portion of the length of the channel.*

*19. The hair drying and shaping system of claim 18 comprising two or more vertical extensions having a triangular shape in vertical cross section orthogonal to the length of the vacuum channel.*

*20. A hair drying and shaping system comprising:*

*a vacuum channel connected to a vacuum source, the vacuum channel having a substantially rectangular or oval shape in cross-section with a width substantially greater than a height;*

*a hot air channel connected to a hot air source and having communication with the vacuum channel for delivery of heated air into the vacuum channel; and*

*a control interface for determining, setting, and activating features and parameters thereof during operation; and*

*at least one pair of opposable plates disposed in the vacuum channel, the plates having mating flat surfaces, at least one of the plates translatable toward and away from the other by a translation mechanism, providing for straightening a user's hair.*

*21. The hair drying and shaping system of claim 20 wherein one or more of the plates have a cover of absorbent material.*

*22. The hair drying and shaping system of claim 21 wherein the cover retains a solution enabled to enhance straightening of hair.*

*23. The hair drying and shaping system of claim 20 wherein the plates are heated.*

* * * * *